United States Patent [19]

Filipowicz

[11] 4,298,126

[45] Nov. 3, 1981

[54] ADJUSTABLE HOLDER

[75] Inventor: Edwin A. Filipowicz, Greenfield, Wis.

[73] Assignee: Griffith-Hope Company, Milwaukee, Wis.

[21] Appl. No.: 69,785

[22] Filed: Aug. 27, 1979

[51] Int. Cl.[3] ..... A47F 7/00

[52] U.S. Cl. ..... 211/50; 248/172

[58] Field of Search ..... 211/43, 50, 175; 248/172, 176, 188.2

[56] References Cited

U.S. PATENT DOCUMENTS

| | | | |
|---|---|---|---|
| D. 170,315 | 9/1953 | Gerber | 248/172 X |
| 584,906 | 6/1897 | Tribolet | 211/49 R |
| 1,068,914 | 7/1913 | Montgomery | 211/49 R |
| 1,364,336 | 1/1921 | White | 211/50 |
| 1,501,087 | 7/1924 | Anderson | 211/50 |
| 1,515,058 | 11/1924 | Lindhe | 211/175 X |
| 1,550,138 | 8/1925 | Baker | 248/176 X |
| 2,569,729 | 10/1951 | Nold | 248/188.2 X |
| 2,917,262 | 12/1959 | Huff | 248/172 |
| 3,269,547 | 8/1966 | Chamberlin | 211/43 X |
| 3,494,583 | 2/1970 | Parr | 248/125 X |

*Primary Examiner*—J. Franklin Foss

*Attorney, Agent, or Firm*—Andrus, Sceales, Starke & Sawall

[57] ABSTRACT

An adjustable holder including a base to support a stack of articles, such as folded napkins. Retaining members are connected to the sides of the base and define a compartment within which the articles are retained. Each retaining member includes a horizontal section which is disposed beneath the base and a vertical section. A locking member is mounted on the undersurface of the base and is engaged with the horizontal section of each retaining member. Each locking member is composed of a pair of diverging arms having aligned openings to receive the horizontal section of the retaining member. By flexing the diverging arms toward a generally parallel condition, the horizontal section of the retaining member can be freely moved toward and away from the base to accommodate articles of different sizes and by releasing the diverging arms, the horizontal section will be firmly gripped to maintain the retaining member in a given position.

9 Claims, 4 Drawing Figures

9
3
2
8
18
16
16
9
16
16
2
4
1
8
3
17
14
7
6
17
7
6

17
15
22
21
15
17
3
12
6
13
12
6
4
5
2
7
7
13
10
11
21
19
20
22
13
10
14
14
11
3
22
21
19
4
22
3
7
2
7
12
13
6
12
17
15
21
15
4
17
3
13
6

2
11
4
1
6
8
7
13
5
10
12
12

4
1
20
3
16
15
6
14
22
17
19
5
21
21

ADJUSTABLE HOLDER

BACKGROUND OF THE INVENTION

One common type of napkin holder, as used in restaurants and commercial establishments, to hold a stack of folded napkins, is formed with either two or three side walls and has dispensing openings on either one side or two opposite sides.

Another type of napkin holder as used in the past includes a base, and wire form retaining members extend upwardly from the sides of the base. The conventional napkin holder is designed with a size to hold a stack of folded napkins of given dimensions and cannot normally be used with folded napkins of different dimensions.

Holders or displays having a base to support articles and oppositely located retaining members that can be adjusted toward and away from the base, are disclosed in U.S. Pat. Nos. 584,906 and 2,061,937. However, the prior art fails to disclose an adjustable napkin holder having retaining members that can be conveniently and positively extended and contracted to accommodate napkins of varying dimensions.

SUMMARY OF THE INVENTION

The invention is directed to an adjustable holder for supporting a stack of articles and having side retaining members that can be readily extended and contracted with respect to the base to accommodate articles of various dimensions. More specifically, the holder includes a generally rectangular support or base, and wire form retaining members are connected to each side of the base and define a compartment which receives a stack of the articles. Each retaining member includes a vertical section and a horizontal section which is disposed beneath the base and is movable toward and away from the base.

To restrain each horizontal section against movement relative to the base, a locking member is mounted on the underside of the base and includes a pair of diverging arms having aligned openings to receive the respective horizontal section of the retaining member. By flexing the arms toward a generally parallel condition, the horizontal section of the retaining member can be freely moved within the openings to extend and retract the retaining member. By releasing the arms, the arms will spring back to a diverging condition to firmly grip the horizontal section and lock the retaining member in the given position.

The retaining members located at opposite sides of the base can be formed with downwardly extending bent portions which define feet to support the holder on a table or other supporting surface.

The invention provides a simple and inexpensive adjustable napkin holder having wire form, side retaining members that can be conveniently extended and contracted with respect to the base to accommodate napkins of varying size.

The holder can be employed to hold or support a wide variety of products such as folded napkins, coasters, towels, food trays, plastic cup lids, sheet material, and the like.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
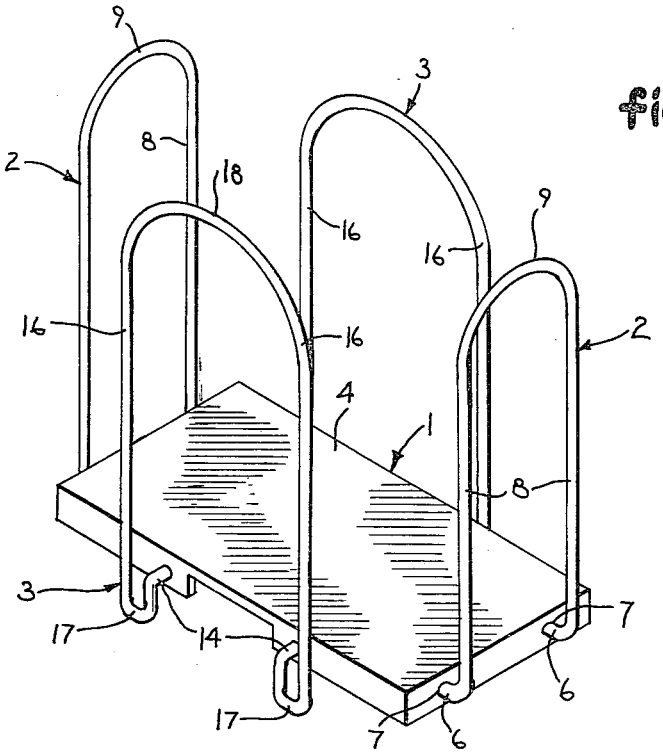
FIG. 1 is a perspective view of the napkin holder of the invention.

The drawings illustrate an improved adjustable holder having a particular use as a napkin holder, comprising a generally rectangular base 1, and a pair of wire form retaining members 2 are connected to opposite sides of the base, while a pair of wire form retaining members 3 are connected to the ends of the base. The base 1 includes a generally flat upper surface 4 and a downwardly extending peripheral flange 5.

The retaining members 2 are each composed of a pair of horizontal sections 6 which are disposed within openings 7 in the flange 5 and vertical sections 8 extend upwardly from the horizontal sections 6 and are joined together at their upper extremities by loop portion 9.

Figure 2:
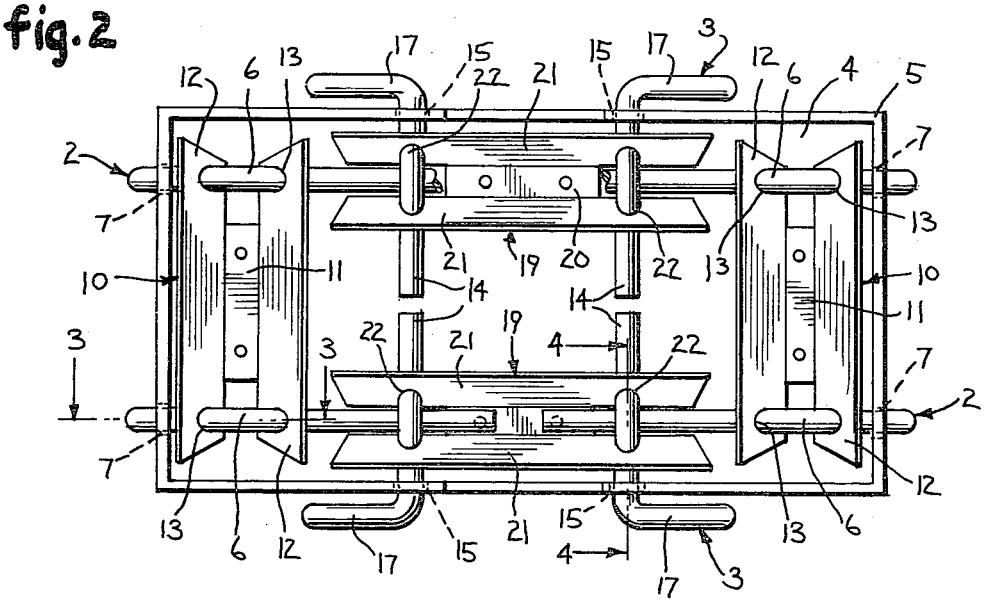
FIG. 2 is a bottom view of the napkin holder.
Figure 3:
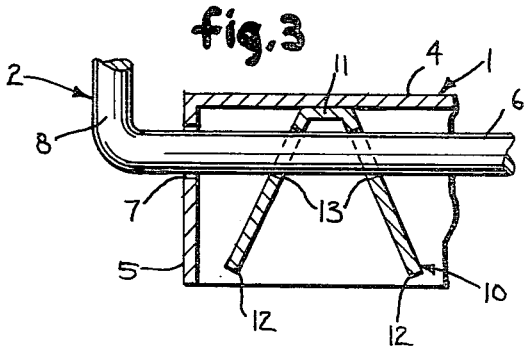
FIG. 3 is a section taken along line 3—3 of FIG. 2.

The horizontal sections 6 of each retaining member 2 are adapted to be moved toward and away from the base to accommodate various sizes of folded napkins and a locking member 10 is mounted on the underside of surface 4 to lock the horizontal sections against movement. Each locking member, as best shown in FIGS. 2 and 3, is composed of a central section 11 which is secured to the underside of surface 4, and a pair of arms 12 that diverge downwardly and outwardly from the central section 11. The arms 12 are provided with two pair of openings 13 and the horizontal sections 6 of the retaining member 2 are mounted within the respective aligned openings. The arms 12 can be manually flexed, and by flexing the arms toward a parallel condition, the horizontal sections 6 of the retaining member 2 can freely slide within the holes 13 which are slightly oversized. By releasing the pressure on the arms 12, the arms will spring back to the diverging condition to grip the horizontal sections 6 and prevent relative movement between the horizontal sections and the arms 12.

The retaining members 3 are formed with a construction which is similar to that of retaining members 2 and each retaining member 3 includes a pair of horizontal sections 14 which are located along the underside of the base and extend outwardly through openings 15 in the flange 5. Each retaining member 3 also includes a pair of vertical sections 16 which are connected to the horizontal sections through the downwardly bent portions 17. The upper ends of the vertical sections are connected together by a loop portion 18. The bent portions 17 function as supporting feet to support the napkin holder above the table or other supporting surface.

A locking mechanism 19 is associated with the horizontal sections 14 of each retaining member 3 and is constructed similar to the locking members 10, previously described. More specifically, each locking member 19 is composed of a central section 20, which is connected to the undersurface of base 4, and a pair of diverging arms 21 which extend downwardly and outwardly from the central section 20. Arms 21 are provided with aligned openings 22 which receive the horizontal sections 14 of the respective retaining members 3.

Figure 4:
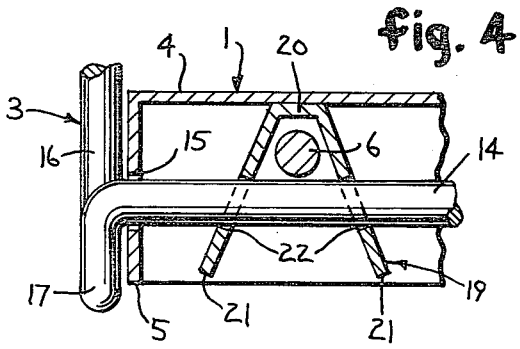
FIG. 4 is a section taken along line 4—4 of FIG. 2.

As best shown in FIG. 4, the horizontal sections 14 are located at a lower level than the horizontal sections 6, so that the horizontal sections 6 will be received between the central section 20 and the horizontal sections 14, as shown in FIG. 4.

To extend or contract the retaining members 3, the operator manually flexes the arms 21 toward a parallel condition and the horizontal sections 14 can then be freely moved within aligned holes 22 to extend or contract the retaining members 3.

The holder of the invention is a simple and inexpensive construction having a locking mechanism that readily permits the retaining members to be extended and contracted, as desired, to accommodate folded napkins of various sizes. In addition, the retaining members 3 perform a secondary function in that the downwardly bent portions 17 serve as supporting feet to support and space the base 4 above the table.

While the above description has illustrated the invention as a napkin holder, it is contemplated that it can be used to hold stacks of different materials, such as food trays, cup lids, coasters, paper plates, towels, sheet materials, discs or records, and the like.

Similarly, while the base is shown as rectangular it can be circular, oval or any other desired shape and can include any number of adjustable retaining members.

Various modes of carrying out the invention are contemplated as being within the scope of the following claims particularly pointing out and distinctly claiming the subject matter which is regarded as the invention.

I claim:

1. An adjustable holder for holding articles, comprising a base having an upper surface to support a stack of articles, a plurality of retaining members connected to the sides of the base and extending upwardly from the base, each retaining member including a first section disposed beneath the base and a second section connected to the first section and extending upwardly beyond the base, oppositely disposed retaining members include connecting sections connecting the respective first section and the second section, said connecting sections extending downwardly from the first sections to a level below the base to provide a support for the holder, a locking member connected to the base and engaged with the first section of each retaining member to lock the first section against movement with respect to the base, each locking member including a pair of spaced arms disposed in a non-parallel condition and having aligned openings to receive the respective first section, flexing of said arms toward a parallel condition enabling the respective first section to be freely moved within the aligned openings to extend and retract the retaining member relative to the base, release of the arms causing the arms to return to said non-parallel condition to firmly grip the respective first section and lock the first section against movement relative to the base.

2. The holder of claim 1, and including a downardly extending flange disposed on said base, said flange being provided with a plurality of apertures to receive the first sections of the retaining members.

3. The holder of claim 1, wherein each locking member includes a central portion secured to the underside of the base, the upper ends of said arms being connected to the central portion and said arms diverging downwardly from the central portion.

4. An adjustable holder, comprising a base having an upper surface to support a stack of articles, a plurality of retaining members connected to sides of the base and extending upwardly from the base, each retaining member including a pair of spaced horizontal sections that extend beneath the base and a pair of spaced vertical sections connected to the outer extremities of the horizontal sections, each retaining member also including an upper portion connecting the upper ends of the vertical sections, the horizontal section of each retaining member is disposed at a different vertical level than the horizontal section of an adjacent retaining member, whereby the horizontal sections of adjacent retaining members will not interfere with each other during movement relative to the base, and locking members connected to the underside of the base and engageable with at least one of the horizontal sections of each retaining member, each locking member including a pair of downwardly and outwardly diverging arms having aligned openings to receive the respective horizontal section, flexing of the arms to a generally parallel condition enabling the respective horizontal section to be freely moved within the openings to thereby permit the retaining member to be extended and retracted relative to the base, release of said arms causing the arms to move to a diverging condition to firmly grip the respective horizontal section and lock the retaining member against extension and retraction.

5. The holder of claim 4, wherein the base has a plurality of sides and a retaining member is connected to each side of the base.

6. The holder of claim 5, and including a peripheral flange extending downwardly from the sides of the base, said flange having a plurality of apertures to slidably receive the horizontal sections of the retaining members.

7. The holder of claim 4, wherein a pair of opposite disposed retaining members are provided with connecting sections connecting the respective horizontal sections and the vertical sections, said connecting sections extending downwardly from the horizontal section to a level beneath the base to constitute supports for the holder.

8. The holder of claim 4, wherein each locking member includes a central portion secured to the undersurface of the base, said arms extending downwardly and outwardly from the central portion and being capable of being flexed relative to the central portion.

9. An adjustable holder for holding articles, comprising a base having an upper surface to support a stack of articles, said base having a pair of opposed ends and a pair of opposed sides, wire form retaining members connected to each side and to each end of the base and extending upwardly from the base, each retaining member including a pair of spaced horizontal sections and a pair of spaced vertical sections connected to the outer extremities of the horizontal sections, and a generally U-shaped elongated locking member for each retaining member and connected to the underside of the base, each locking member including a central portion secured to the underside of the base and a pair of arms which diverge downwardly and outwardly from said central portion, said arms having pairs of aligned openings to receive the horizontal sections of the respective retaining member, flexing of the arms to a generally parallel position enabling the respective horizontal sections to be freely moved within the openings to thereby permit the retaining members to be individually extended and retracted relative to the base, release of said arms causing the arms to move to a diverging condition to firmly grip the respective horizontal sections and lock the retaining member against the extension and retraction, the horizontal sections of the retaining members associated with each end of the base being disposed longitudinally within the elongated locking members associated with the retaining members at the sides of the base, and the horizontal sections of the retaining members at the ends of the base being disposed at a different vertical level than the horizontal sections of the retaining members at the sides of the base.

* * * * *